US011783763B1

(12) United States Patent
Chen et al.

(10) Patent No.: US 11,783,763 B1
(45) Date of Patent: Oct. 10, 2023

(54) DISPLAY CONTROL METHOD AND DISPLAY DEVICE

(71) Applicant: TCL CHINA STAR OPTOELECTRONICS TECHNOLOGY CO., LTD., Guangdong (CN)

(72) Inventors: Yi Chen, Guangdong (CN); Ling Xu, Guangdong (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/935,038

(22) Filed: Sep. 23, 2022

(30) Foreign Application Priority Data

Jul. 15, 2022 (CN) ..... 202210835510.5

(51) Int. Cl.
*G09G 3/32* (2016.01)

(52) U.S. Cl.
CPC ..... *G09G 3/32* (2013.01); *G09G 2320/0233* (2013.01); *G09G 2320/0626* (2013.01); *G09G 2320/0686* (2013.01); *G09G 2360/16* (2013.01)

(58) Field of Classification Search
CPC ..... G09G 3/32; G09G 2320/0233; G09G 2320/0626; G09G 2320/0686; G09G 2360/16
See application file for complete search history.

(56) References Cited

U.S. PATENT DOCUMENTS

| | | | | |
|---|---|---|---|---|
| 8,184,088 | B2 * | 5/2012 | Nonaka | G09G 3/3426 345/698 |
| 11,308,894 | B2 * | 4/2022 | Huang | G09G 3/03 |
| 2017/0059960 | A1 * | 3/2017 | Shi | G06F 3/011 |
| 2017/0323619 | A1 * | 11/2017 | Lee | G02B 27/0101 |
| 2023/0154425 | A1 * | 5/2023 | Hai | G09G 3/36 345/55 |

* cited by examiner

*Primary Examiner* — Gene W Lee
(74) *Attorney, Agent, or Firm* — PV IP PC; Wei Te Chung; Zhigang Ma

(57) ABSTRACT

A display control method and a display device are provided. In the display control method, when a display parameter difference between a first display section and at least one second display section is out of a preset range, an initial luminance of a respective display section is adjusted, so that the display parameter difference between the first display section and the at least one second display section is in the preset range.

12 Claims, 3 Drawing Sheets

DISPLAY CONTROL METHOD AND DISPLAY DEVICE

CROSS-REFERENCE TO RELATED APPLICATION

This application is based on and claims priority to China Patent Application No. 202210835510.5, filed on Jul. 15, 2022, in the China Intellectual Property Office, the disclosure of which is incorporated by reference herein in its entirety.

TECHNICAL FIELD

The present disclosure relates to a field of display technology, and more particularly, to a display control method and a display device.

BACKGROUND

In a current luminance homogenization process, when the luminance difference between a plurality of display sections in a display region is relatively larger, a repair effect is generally degraded. That is, after a luminance homogenization repair process is performed, although the luminance of every display section changes synchronously, the luminance difference between various display sections still maintains a luminance difference proportion before repair. In other word, the display region of a display device still has a luminance unevenness such as mura. Each display section may be a part of a single integrated-screen display region or a display region corresponding to a display screen of spliced screens.

SUMMARY

According to a first aspect, the present disclosure provides a display control method including configuring a display region to include a first display section and at least one second display section; determining whether a display parameter difference between the first display section and the at least one second display section is in a preset range; and adjusting, if not, an initial luminance of a respective one of the first display section and the at least one second display section, so that the display parameter difference between the first display section and the at least one second display section is in the preset range.

In some embodiments, the display control method may further include configuring the initial luminance of the first display section as target luminance, wherein the adjusting, if not, the initial luminance of the respective one of the display sections, so that the display parameter difference between the first display section and the at least one second display section is in the preset range may include: if not, adjusting the initial luminance of the at least one second display section to the target luminance.

In some embodiments, before the configuring the initial luminance of the first display section as target luminance, the method may further include: determining whether luminance uniformity of the first display section meets a preset uniformity range; and if not, adjusting the luminance uniformity of the first display section so that the luminance uniformity of the first display section meets the preset uniformity range.

In some embodiments, the display control method may further include: configuring preset luminance as target luminance, wherein the preset luminance may be different from each of the initial luminance of the first display section and the initial luminance of the at least one second display section, and the adjusting, if not, the initial luminance of the respective one of the display sections, so that the display parameter difference between the first display section and the at least one second display section is in the preset range may include: if not, adjusting the initial luminance of the first display section and the initial luminance of the at least one second display section to the target luminance.

In some embodiments, each of the first display section and the at least one second display section may include at least one display sub-region, and the adjusting, if not, the initial luminance of the respective one of the display sections, so that the display parameter difference between the first display section and the at least one second display section may be in the preset range may include: if not, adjusting the initial luminance of the at least one display sub-region so that the display parameter difference between the first display section and the at least one second display section is in the preset range.

In some embodiments, the adjusting, if not, the initial luminance of the respective one of the display sections, so that the display parameter difference between the first display section and the at least one second display section is in the preset range may include: if not, adjusting a light-emitting current and/or light-emitting time of the at least one display sub-region in one frame, to control the display parameter difference between the first display section and the at least one second display section to be in the preset range.

In some embodiments, the determining whether the display parameter difference between the first display section and the at least one second display section is in the preset range may include: determining whether a luminance difference between the first display section and the at least one second display section is in a preset luminance difference range; and/or determining whether a ratio of an area of a continuous region of the first display section and the at least one second display section having the luminance difference in the preset luminance difference range to a total area of the display region is in a preset area ratio range.

According to a second aspect, the present disclosure provides a display device including: a configuration module configured to configure a display region to include a first display section and at least one second display section; a determine module configured to determine whether a display parameter difference between the first display section and the at least one second display section is in a preset range; an adjustment module configured to adjust an initial luminance of a respective display section of the first display section and the at least one second display section in response to the display parameter difference out of a preset range so that the display parameter difference between the first display section and the at least one second display section is in the preset range.

In some embodiments, the display device may include a plurality of display screens, and each of the display screens may correspond to one of the first display section and the second display section.

In some embodiments, each of the first display section and the second display section may include a plurality of display sub-regions.

BRIEF DESCRIPTION OF THE DRAWINGS

The technical solution and other beneficial effects of the present disclosure will be apparent from the following detailed description of specific implementations thereof, taken in conjunction with the accompanying drawings.

DETAILED DESCRIPTION OF THE EMBODIMENTS

The technical solutions in the embodiments of the present disclosure will be clearly and completely described with reference to accompanying drawings in the embodiments of the present disclosure in which: It will be apparent that the described embodiments are only part of, but not all of, the embodiments of the present disclosure. Based on the embodiments in the present disclosure, all other embodiments obtained by a person skilled in the art without any creative work are within the scope of the present disclosure.

Figure 1:
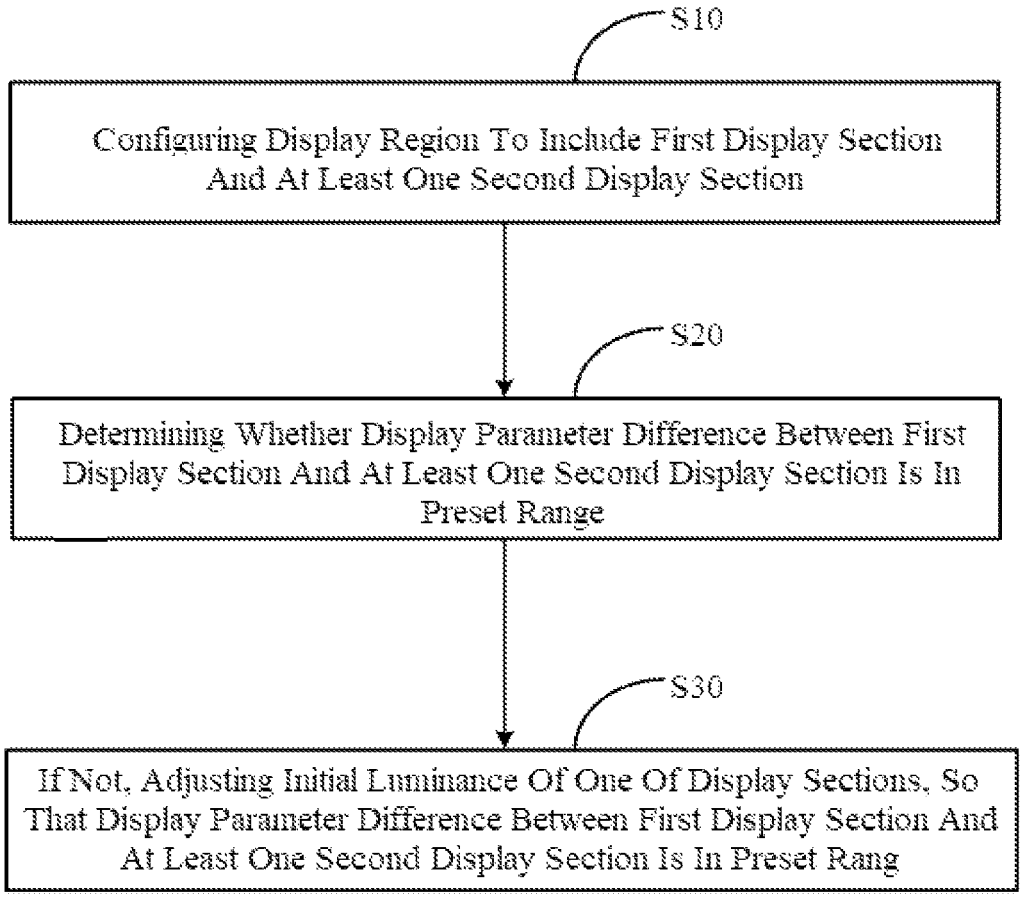
FIG. 1 is a schematic flowchart of a display control method according to an embodiment of the present disclosure.
Figure 2:
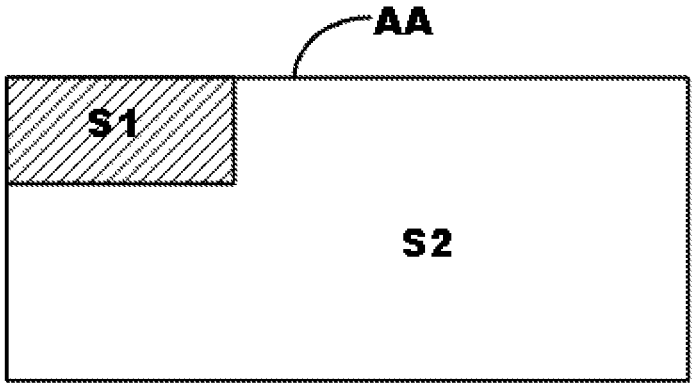
FIG. 2 is a schematic structural view of a display region according to an embodiment of the present disclosure.
Figure 3:
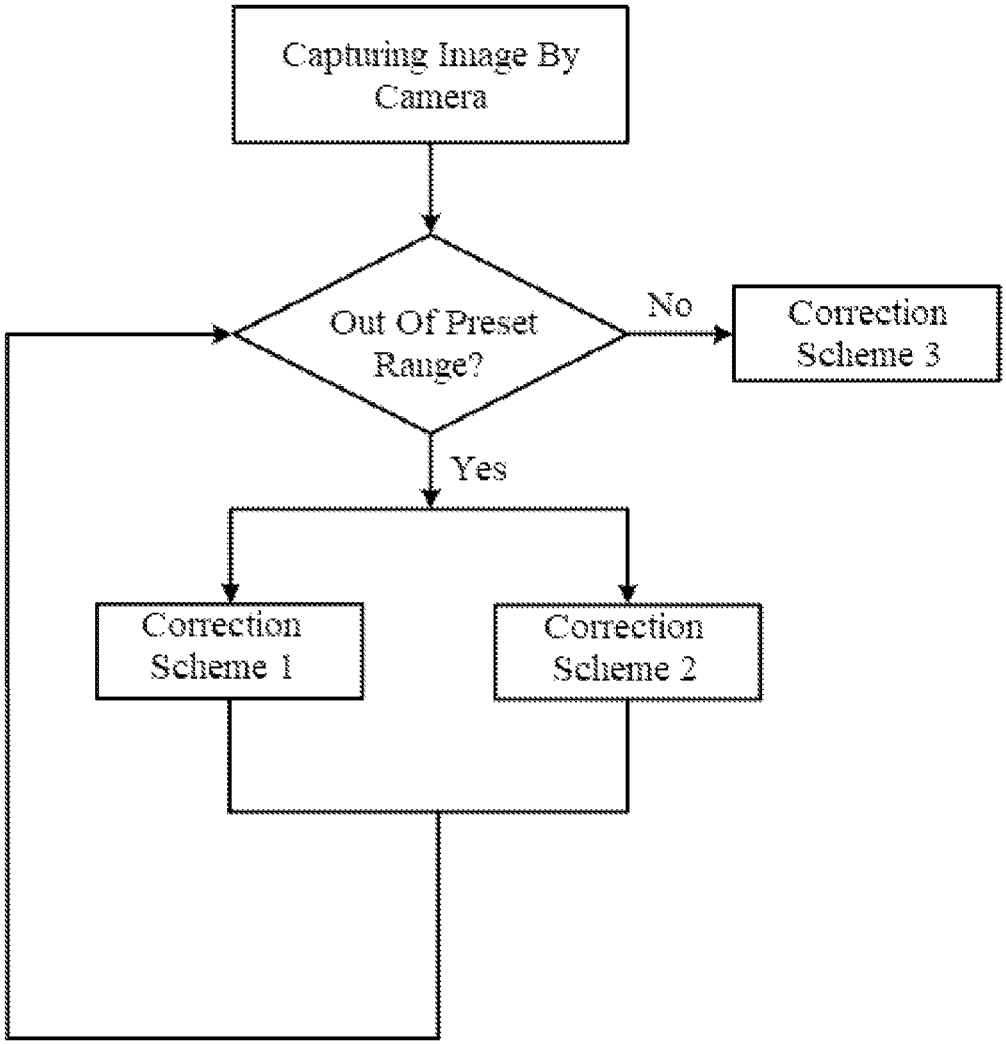
FIG. 3 is another flowchart of a display control method according to an embodiment of the present disclosure.

In view of the above-mentioned technical problem of larger luminance difference between different display sections, the present embodiment provides a display control method. Referring to FIGS. 1 to 3, as shown in FIG. 1, the display control method includes the following steps:

Step S10: configuring a display region to include a first display section and at least one second display section.

It is noted that the display region may be (or correspond to) an entire display region of a single display screen. In this case, the display section is a portion of the display region of the single display screen. The display region may also be (or correspond to) an entire display region formed by splicing a plurality of display screens. In this case, each display region may correspond to a display region constructed by one or more display screens.

Step S20: determining whether a display parameter difference between the first display section and the at least one second display section is in a preset range.

It is noted that the display parameter difference may include luminance difference and an area of a display region in which the luminance difference occurs. The luminance difference between the plurality of display sections may be obtained from original data of a respective image photographed by a camera. The original data may include luminance and coordinates of sub-pixels. Different display sections are defined by the coordinates of the sub-pixels. Average luminance of each display section is obtained by the luminance of every sub-pixel arranged in a respective display section. The luminance difference between the different display sections, that is, the luminance difference of the display region, is obtained by comparing the average luminance of the respective display sections. For sub-pixels of which the luminance difference is in a certain range, an arrangement region in which these sub-pixels are located may be determined by the coordinates of these sub-pixels. The size of the area of the display region in which the luminance difference occurs may be obtained based on distances between the sub-pixels.

Step S30: If not, adjusting an initial luminance of a respective one of the display sections, so that the display parameter difference between the first display section and the at least one second display section is in the preset range.

It is noted that the above average luminance before the adjustment by the display control method may be referred to as the initial luminance. The above average luminance after the adjustment by the display control method may be referred to as target luminance. Here, the target luminance may have a plurality of different values. However, it will be understood that the decrease of the luminance difference between different display sections through the display control method will not be affected regardless of the values.

It will be appreciated that in the display control method according to the present embodiment, under the condition that the display parameter difference between the first display section and the at least one second display section is out of the preset range, the initial luminance of the respective one (or at least one) of the display sections may be adjusted so that the display parameter difference between the first display section and the at least one second display section is in the preset range. Therefore, the luminance difference between the display sections may be reduced and luminance uniformity of the display region may be improved.

In one embodiment, the display control method further includes: configuring the initial luminance of the first display section as the target luminance. The step of "adjusting, if not, the initial luminance of the respective one of the display sections, so that the display parameter difference between the first display section and the at least one second display section is in the preset range" specifically includes: if not, adjusting the initial luminance of the at least one second display section to the target luminance.

It is noted that in the present embodiment, the initial luminance of the first display section is used as the target luminance, and the luminance difference between the different display sections is reduced by adjusting the initial luminance of the at least one second display section to the target luminance. The number of display sections of which the luminance needs to be adjusted may be reduced by means of this method, and working capacity required for luminance adjustment may be advantageously reduced.

In one embodiment, before the step of "configuring the initial luminance of the first display section as the target luminance", the method further includes: determining whether the luminance uniformity of the first display section meets a preset uniformity range (or be in the preset uniformity range); and if not, adjusting the luminance uniformity of the first display section so that the luminance uniformity of the first display section meets the preset uniformity range.

It is noted that in the present embodiment, the luminance uniformity of the first display section itself may be improved, while the uniformity between the luminance of the at least one second display section and the first display section may be improved, so that the luminance uniformity among the plurality of display sections may be further improved.

In one embodiment, the display control method further includes: configuring preset luminance as the target luminance, wherein the preset luminance is different from the initial luminance of the first display section or the initial luminance of the at least one second display section. The step of "adjusting, if not, the initial luminance of the respective one of the display sections, so that the display parameter difference between the first display section and the at least one second display section is in the preset range" specifically includes: if not, adjusting the initial luminance of the first display section and/or the initial luminance of the at least one second display section to the target luminance.

It is noted that the display region may be the display region AA shown in FIG. 2, the first display region may be the display region S1 shown in FIG. 2, and the second display region may be at least a portion of the display region S2 shown in FIG. 2. The arrangement of the display region S1 and the display region S2 is not limited to those shown in FIG. 2, but may be in various other arrangement forms. For example, the area of the display region S1 may be equal to the area of the display region S2. Alternatively, the display region S2 may surround the display region S1. Alternatively, the display region S2 may include a plurality of second display sections.

It is noted that in the present embodiment, the preset luminance is used as the target luminance, and the luminance difference between the different display sections is reduced by adjusting the initial luminance of the first display section and/or the at least one second display section to the target luminance. In the present method, the initial luminance of all display sections whose luminance is inconsistent with the preset luminance may be adjusted. Under the condition that the initial luminance of at least one display section is consistent with the preset luminance, the number of display sections whose luminance needs to be adjusted may be reduced, and the working capacity required for the luminance adjustment may be advantageously reduced.

In one embodiment, each of the first display section and the at least one second display section includes at least one display sub-region. The step of "adjusting, if not, the initial luminance of the respective one of the display sections, so that the display parameter difference between the first display section and the at least one second display section is in the preset range" specifically includes: if not, adjusting the initial luminance of the at least one display sub-region so that the display parameter difference between the first display section and the at least one second display section is in the preset range.

It is noted that in the present embodiment, the initial luminance of at least one display sub-region of the first display section and/or the at least one second display section may be adjusted. For example, the initial luminance of at least one display sub-region of the first display section or the initial luminance of at least one display sub-region of the at least one second display section may be adjusted with the target luminance as a reference target. Alternatively, the initial luminance of at least one display sub-region of the first display section and the initial luminance of at least one display sub-region of the at least one second display section may be adjusted at the same time. In this bidirectional adjustment way, an adjustment speed for the luminance uniformity may be improved.

In one embodiment, The step of "adjusting, if not, the initial luminance of the respective one of the display sections, so that the display parameter difference between the first display section and the at least one second display section is in the preset range" specifically includes: if not, adjusting a light-emitting current and/or light-emitting time of the at least one display sub-region in one frame, to control the display parameter difference between the first display section and the at least one second display section to be in the preset range.

It is noted that, in the present embodiment, each display sub-region may include at least one sub-pixel, and the average luminance of each display sub-region may be adjusted by adjusting the luminance of at least one sub-pixel in the display sub-region. That is, the average luminance of every display sub-region may be adjusted and controlled separately, so that the luminance required by each display sub-region may be quickly and accurately realized, thereby improving the speed and accuracy of the luminance uniformity between different display sub-regions.

In one embodiment, the step of "determining whether the display parameter difference between the first display section and the at least one second display section is in the preset range" specifically includes: determining whether the luminance difference between the first display section and the at least one second display section is in the preset luminance difference range; and/or determining whether a ratio of an area of a continuous region(s) of the first display section and the at least one second display section having the luminance difference in the preset luminance difference range to a total area of the display region is in a preset area ratio range. That is, the step of "determining whether the ratio of the area of the continuous region of the first display section and the at least one second display section having the luminance difference in the preset luminance difference range to the total area of the display region is in the preset area ratio range" may be include: determining, in the first display section and the at least one second display section, display sections that meets the following condition—the luminance difference is in the preset luminance difference range; and/or determining whether a ratio of an area of a continuous region(s) formed by the display sections that meets the above condition to a total area of the display region is in the preset area ratio range.

It is noted that in the present embodiment, the display parameter difference and the preset range are further explained, and the luminance difference is a ratio, that is, a ratio of an absolute value of the luminance discrepancy between two display sections to the luminance of one of the two display sections of higher luminance or one of two display sections of lower luminance.

In one embodiment, the present embodiment provides a display control method including: configuring the display region to include the plurality of display sections; determining whether the luminance difference and the area of the region corresponding to the luminance difference of the display region is in the preset range; If not, adjusting the initial luminance of a respective display section to the target luminance.

It may be appreciated that in the display control method according to the present embodiment, in response to the luminance difference of the display region and the area of the region corresponding to the luminance difference is out of the preset range, that is, when the luminance difference between different display sections is larger, the initial luminance of at least one of the display sections is adjusted to the target luminance, so that the luminance difference between the respective display sections may be reduced, and the luminance uniformity of the display region may be improved.

In one embodiment, the display control method further includes: configuring the plurality of display sections to include the first display section and the at least one second display section; configuring the preset luminance as the target luminance, wherein the preset luminance is different from each of the initial luminance of the first display section or the initial luminance of the at least one second display section; determining whether the luminance difference between the first display section and the at least one second display section and the area of the region corresponding to the luminance difference is in the preset range; and if not, adjusting the initial luminance of the first display section and the initial luminance of the at least one second display section to the target luminance.

In one embodiment, the display control method further includes: configuring the plurality of display sections to include the first display section and the at least one second display section; configuring the initial luminance of the first display section as the target luminance; determining whether the luminance difference between the first display section and the at least one second display section and the area of the region corresponding to the luminance difference is in the preset range; and if not, adjusting the initial luminance of the at least one second display section to the target luminance.

In one embodiment, the display control method further includes: configuring the plurality of display sections to include the first display section and the at least one second display section; configuring the initial luminance of the at least one second display section as the target luminance; determining whether the luminance difference between the first display section and the at least one second display section and the area of the region corresponding to the luminance difference is in the preset range; and if not, adjusting the initial luminance of the first display section to the target luminance.

In one embodiment, the display control method further includes: configuring the plurality of display sections to include the first display section and the at least one second display section, wherein the first display section includes the at least one first display sub-region, and each of the at least one second display section includes at least one second display sub-region; determining whether the luminance difference between the first display section and the at least one second display section and the area of the region corresponding to the luminance difference is in the preset range; and if not, adjusting the initial luminance of the at least one first display sub-region and/or the initial luminance of the at least one second display sub-region, so that the luminance difference between the first display section and the at least one second display section and the area of the region corresponding to the luminance difference is controlled in the preset range.

In one embodiment, the display control method further includes: configuring each of the first display sub-region and the at least one second display sub-region includes at least one sub-pixel; adjusting the light-emitting current and/or the light-emitting time of the at least one sub-pixel in one frame, so that the luminance difference between the first display section and the at least one second display section and the area of the region corresponding to the luminance difference is controlled in the preset range.

It is noted that the present embodiment provides a specific method for adjusting the luminance of each display sub-region. The average luminance of the display sub-region may be increased by increasing the light-emitting current and/or the light-emitting time, and the average luminance of the display sub-region in which the display sub-region is located may be increased. On the contrary, the average luminance of the display sub-region may be reduced by reducing the light-emitting current and/or the light-emitting time, and the average luminance of the display sub-region in which the display sub-region is located may be reduced.

In one embodiment, the display control method further includes: acquiring initial luminance of the plurality of display sections; determining whether the luminance difference between different display sections is in a preset luminance difference range; if not, determining whether the ratio of the area of the continuous region corresponding to the luminance difference out of the preset luminance difference range to the area of the display region is in the preset area ratio range; and if not, adjusting the initial luminance of the respective display section to the target luminance.

It is noted that the above preset luminance difference range may be set reasonably according to a brightness difference recognized by the human eye, and may be set comprehensively with reference to at least one of the observation distance from the human eye to the display region and the area size of the display region.

In one embodiment, the display control method further includes: configuring the preset luminance difference range to be greater than or equal to 0 and less than or equal to 0.5. The preset area ratio range is configured to be greater than or equal to 0 and less than or equal to 0.5.

It is noted that the preset luminance difference range in this embodiment may be, for example, 0.1, 0.2, 0.3, 0.4, or the like, and the preset area ratio range may be, for example, 0.1, 0.2, 0.3, 0.4, or the like.

For example, if the luminance of one display section is 3nit and the luminance of the other display section is 6nit, the absolute value of the luminance discrepancy between these two display sections is 3nit. In this case, the luminance difference is 3nit/6nit=0.5, which does not out of the preset luminance difference range.

For another example, if the luminance of one display section is 3nit and the luminance of the other display section is 10nit, the absolute value of the luminance discrepancy between these two display sections is 7nit. In this case, the luminance difference is 7nit/10nit=0.7, which exceeds the preset luminance difference range.

In one embodiment, the display control method further includes: determining whether the luminance difference of the display section and the area of the region corresponding to the luminance difference is in the preset range; and if yes, the initial luminance of the display region is adjusted to the target luminance.

It is noted that, in the present embodiment, that the luminance difference of the display region and the area of the region corresponding to the luminance difference is in the preset range indicates that the luminance difference between the different display sections and the area of the region corresponding to the luminance difference are smaller. In this case, the luminance uniformity of the display region may be improved by fine-tuning the luminance of at least one display section (such as every display section). The target luminance may have a value different from that of the above-described embodiment. For example, the target luminance may be a higher luminance value or a highest luminance value of the sub-pixels in the display region, or may be an average luminance value of the sub-pixels in the display region.

In sum, the above display control method may be performed according to the flow shown in FIG. 3, as follows:

capturing an image by a camera. Wherein the camera generates raw data corresponding to the image.

determining whether the luminance difference of the display region and the area of the region corresponding to the luminance difference are out of the preset range, and the detailed determination process may be performed as described in the above embodiments, and details are not described herein.

If yes, performing the correction scheme 1 or the correction scheme 2, and then determining again whether the luminance difference of the display region and the area of the region corresponding to the luminance difference are out of the preset range until the luminance difference of the display region and the area of the region corresponding to the luminance difference are in the preset range, that is, if not, performing the correction scheme 3.

As shown in FIG. 2, the correction scheme 1 may specifically include: under the condition that the difference between the average luminance of the display region S1 and the average luminance of the display region S2 is detected out of the preset range, correcting the average luminance of the display region S1, and correcting the average luminance of the display region S2 based on the corrected average luminance of the display region S1 as the target luminance. Alternatively, under the condition that the difference between the average luminance of the display region S1 and the average luminance of the display region S2 is detected out of the preset range, respectively correcting the average luminance of the display region S1 and the average luminance of the display region S2 according to a preset or generic target luminance.

The correction scheme 2 may specifically include: under the condition that the difference between the average luminance of the display region S1 and the average luminance of the display region S2 is detected out of the preset range, adjusting the light-emitting current and/or the light-emitting time of the sub-pixels in the display sub-regions, that is, a partial region of the display region S1 and/or the display region S2, so that the luminance difference between the different display sections is in the preset range.

In comparison with the correction scheme 1, in the correction scheme 2, one display sub-region is divided into a plurality of display sub-regions, and the smaller the display sub-region is divided, the finer the control for the luminance of every display sub-region is. The refinement degree of the average luminance of the respective display sub-region may be improved.

The correction scheme 3 may specifically include: fine-tuning the luminance of every display sections.

Figure 4:
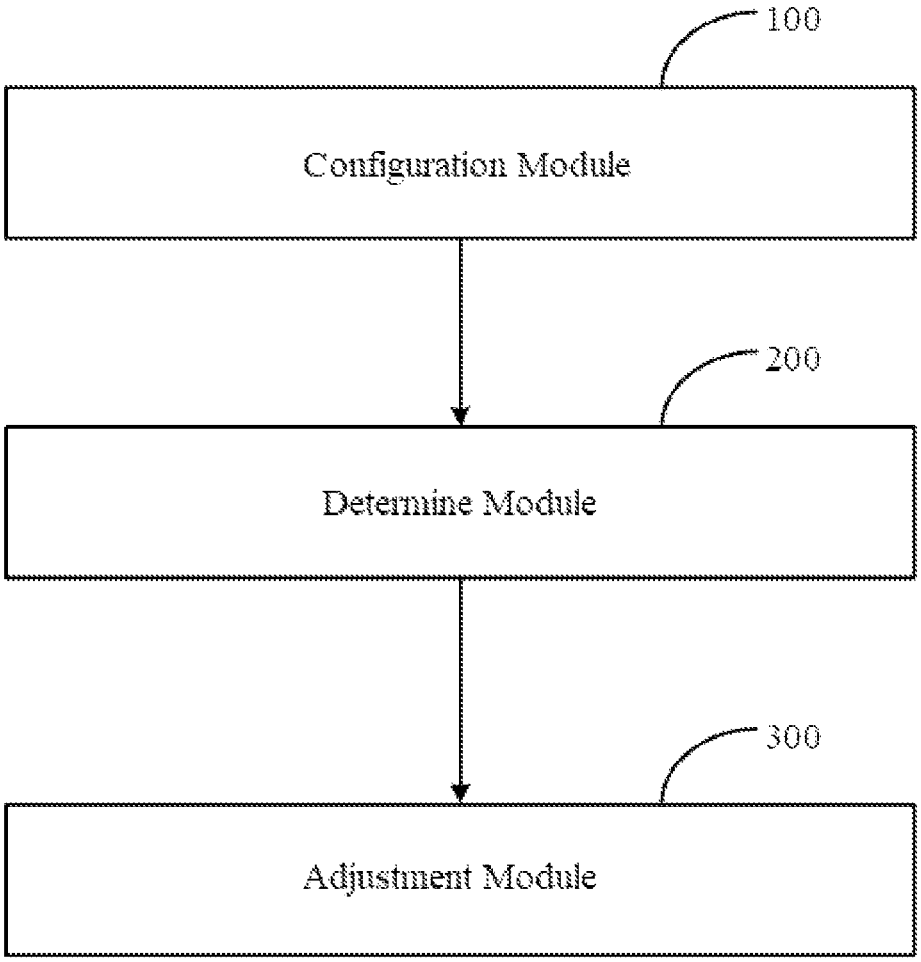
FIG. 4 is a schematic structural view of a display device according to an embodiment of the present disclosure.

In one embodiment, the present embodiment provides a display device. The display device may include a processor for executing the steps of the display control method according to one of the embodiments of the present disclosure. As shown in FIG. 4, the display device includes a configuration module 100, a determine module 200 and an adjustment module 300. The configuration module 100 is configured to configure the display region to include the first display section and the at least one second display section. The determine module 200 is configured to determine whether the display parameter difference between the first display section and the at least one second display section is in the preset range. The adjustment module 300 is configured to adjust the initial luminance of the respective display section in response to the display parameter difference out of the preset range, so that the display parameter difference between the first display section and the at least one second display section is in the preset range.

It will be appreciated that in the display device according to the present embodiment, under the condition that the display parameter difference between the first display section and the at least one second display section is out of the preset range, the initial luminance of the respective display section may be adjusted so that the display parameter difference between the first display section and the at least one second display section is in the preset range, thereby reducing the luminance difference between the respective display sections and improving the luminance uniformity of the display region.

An output terminal of the configuration module 100 is connected to an input terminal of the determine module 200, and an output terminal of the determine module 200 is connected to an input terminal of the adjustment module 300.

In one embodiment, the display device includes a plurality of display screens, each of the display screens corresponds to one of the first display section and the second display section.

It is noted that the luminance difference inside or between the display sections is particularly serious in the spliced screen and is also a technical problem difficult to be solved by the current technical means. In the present disclosure, a better technical effect may be realized in solving the technical problem.

One of the display sections may be the first display section or the second display section. Each of the first display section and the second display section includes a plurality of display sub-regions.

The display screen may be one of an organic light-emitting diode display screen, a micro light-emitting diode display screen, a quantum dot light-emitting diode display screen, or a mini light-emitting diode display screen. Preferably, the above-mentioned display screen is the mini light-emitting diode display screen, which has a better splicing advantage in the process in which the plurality of display screens are spliced to form the display device.

In the above-mentioned embodiments, the description of respective embodiments has its own emphasis, and parts not described in detail in a certain embodiment may be referred to the related description of other embodiments.

A display control method and a display device according to an embodiment of the present disclosure have been described in detail above. A specific example is applied herein to explain the principles and implementations of the present disclosure. The description of the above embodiments is merely provided to help understand the technical solution and the core idea of the present disclosure. It will be appreciated by those of ordinary skill in the art that modifications may still be made to the technical solutions described in the foregoing embodiments, or equivalents may be made to some of the technical features therein. These modifications or substitutions do not depart the essence of the respective technical solutions from the scope of the technical solutions of the embodiments of the present disclosure.

The present disclosure provides a display control method and a display device, to alleviate a technical problem of a larger luminance difference between different display sections Although not shown in detail, the above devices or apparatus may include at least a processor unit, a storage unit and a communication interface, wherein the processor unit, the storage unit, and the communication interface are configured to perform the method of any embodiment of the present disclosure.

The display device may also include a memory, such as random access memory (RAM) or other dynamic memory, for storing information and instructions to be executed by a processor. Such a memory also may be used for storing temporary variables or other intermediate information during execution of instructions to be executed by the processor. The computing system may likewise include a read only memory (ROM) or other static storage device for storing static information and instructions for a processor.

Aspects of the present disclosure may be implemented in any suitable form including hardware, software, firmware or any combination of these.

Furthermore, the order of features in the claims does not imply any specific order in which the features must be performed and in particular the order of individual steps in a method claim does not imply that the steps must be performed in this order. Rather, the steps may be performed in any suitable order. In addition, singular references do not exclude a plurality. Thus, references to 'a', 'an', 'first', 'second', etc. do not preclude a plurality. In the claims, the term 'comprising/comprise' or "including/include" does not exclude the presence of other elements.

What is claimed is:

1. A display control method, comprising the following steps:

configuring a display region to comprise a first display section and at least one second display section;

configuring initial luminance of the first display section as target luminance;

determining whether a display parameter difference between the first display section and the at least one second display section is in a preset range; and in response to determining that the display parameter difference between the first display section and the at least one second display section is not in the preset range, adjusting initial luminance of the at least one second display section to the target luminance.

2. The display control method according to claim 1, wherein the determining of whether the display parameter difference between the first display section and the at least one second display section is in the preset range comprises at least one of the following steps:

determining whether a luminance difference between the first display section and the at least one second display section is in a preset luminance difference range; and determining whether a ratio of an area of a continuous region of the at least one second display section having the luminance difference in the preset luminance difference range to a total area of the display region is in a preset area ratio range.

3. The display control method according to claim 1, wherein before the configuring of the initial luminance of the first display section as the target luminance, the method further comprises:

determining whether luminance uniformity of the first display section meets a preset uniformity range; and in response to determining that luminance uniformity of the first display section does not meet the preset uniformity range, adjusting the luminance uniformity of the first display section so that the luminance uniformity of the first display section meets the preset uniformity range.

4. The display control method according to claim 3, wherein the determining of whether the display parameter difference between the first display section and the at least one second display section is in the preset range comprises at least one of the following steps:

determining whether a luminance difference between the first display section and the at least one second display section is in a preset luminance difference range; and determining whether a ratio of an area of a continuous region of the at least one second display section having the luminance difference in the preset luminance difference range to a total area of the display region is in a preset area ratio range.

5. The display control method according to claim 1, wherein each of the first display section and the at least one second display section comprises at least one display sub-region, and the adjusting of the initial luminance of the at least one second display section to the target luminance in response to determining that the display parameter difference between the first display section and the at least one second display section is not in the preset range comprises:

in response to determining that the display parameter difference between the first display section and the at least one second display section is not in the preset range, adjusting the initial luminance of the at least one display sub-region of the at least one second display section so that the display parameter difference between the first display section and the at least one second display section is in the preset range.

6. The display control method according to claim 5, wherein the adjusting of the initial luminance of the at least one second display section to the target luminance in response to determining that the display parameter difference between the first display section and the at least one second display section is not in the preset range comprises:

in response to determining that the display parameter difference between the first display section and the at least one second display section is not in the preset range, adjusting a light-emitting current and/or light-emitting time of the at least one display sub-region in one frame, to control the display parameter difference between the first display section and the at least one second display section to be in the preset range.

7. The display control method according to claim 6, wherein the determining of whether the display parameter difference between the first display section and the at least one second display section is in the preset range comprises at least one of the following steps:

determining whether a luminance difference between the first display section and the at least one second display section is in a preset luminance difference range; and determining whether a ratio of an area of a continuous region of the first display section and the at least one second display section having the luminance difference in the preset luminance difference range to a total area of the display region is in a preset area ratio range.

8. The display control method according to claim 5, wherein the determining of whether the display parameter difference between the first display section and the at least one second display section is in the preset range comprises at least one of the following steps:

determining whether a luminance difference between the first display section and the at least one second display section is in a preset luminance difference range; and determining whether a ratio of an area of a continuous region of the first display section and the at least one second display section having the luminance difference in the preset luminance difference range to a total area of the display region is in a preset area ratio range.

9. A display control method, comprising the following steps:

configuring a display region to comprise a first display section and at least one second display section;

configuring preset luminance as target luminance, wherein the preset luminance is different from each of initial luminance of the first display section and initial luminance of the at least one second display section;

determining whether a display parameter difference between the first display section and the at least one second display section is in a preset range; and in response to determining that the display parameter difference between the first display section and the at least one second display section is not in the preset range, adjusting the initial luminance of the first display section and the initial luminance of the at least one second display section to the target luminance.

10. The display control method according to claim 9, wherein the determining of whether the display parameter difference between the first display section and the at least one second display section is in the preset range comprises at least one of the following steps:

determining whether a luminance difference between the first display section and the at least one second display section is in a preset luminance difference range; and determining whether a ratio of an area of a continuous region of the first display section and the at least one second display section having the luminance difference in the preset luminance difference range to a total area of the display region is in a preset area ratio range.

11. The display control method according to claim 9, wherein each of the first display section and the at least one second display section comprises at least one display sub-region, and the adjusting of the initial luminance of the at least one second display section to the target luminance in response to determining that the display parameter difference between the first display section and the at least one second display section is not in the preset range comprises:

in response to determining that the display parameter difference between the first display section and the at least one second display section is not in the preset range, adjusting the initial luminance of the at least one display sub-region of the first display section and the at least one display sub-region of the at least one second display section so that the display parameter difference between the first display section and the at least one second display section is in the preset range.

12. The display control method according to claim 11, wherein the adjusting of the initial luminance of the first display section and the initial luminance of the at least one second display section to the target luminance comprises:

in response to determining that the display parameter difference between the first display section and the at least one second display section is not in the preset range, adjusting a light-emitting current and/or light-emitting time of the at least one display sub-region of the first display section and the at least one display sub-region of the at least one second display section in one frame, to control the display parameter difference between the first display section and the at least one second display section to be in the preset range.

* * * * *